US005887719A

United States Patent [19]

Edwards

[11] Patent Number: 5,887,719

[45] Date of Patent: Mar. 30, 1999

[54] MEDICATION STORAGE AND SERVING TRAY DEVICE

[76] Inventor: Oma Fay Edwards, Rte. 1, Box 165, Alvin, Tex. 77511-9306

[21] Appl. No.: 812,038

[22] Filed: Mar. 6, 1997

[51] Int. Cl.[6] ..... B65D 83/04

[52] U.S. Cl. ..... 206/534; 206/538; 220/336

[58] Field of Search ..... 206/538, 216, 206/534, 223, 534.1, 38, 759, 581; 220/521–23, 83, 212, 334, 336; 221/97, 98, 199; 211/77, 78; D7/592, 590, 596, 631, 632

[56] References Cited

U.S. PATENT DOCUMENTS

| | | | |
|---|---|---|---|
| D. 171,893 | 4/1954 | Hills . | |
| D. 323,956 | 2/1992 | Abrams . | |
| D. 324,155 | 2/1992 | Hyman . | |
| 353,554 | 11/1886 | Godfrey | 211/78 |
| 3,442,395 | 5/1969 | Koppelman . | |
| 4,438,853 | 3/1984 | Numbers | 211/77 |
| 4,453,326 | 6/1984 | Hoffman et al. | 40/373 |
| 4,809,897 | 3/1989 | Wright, Jr. | 224/282 |
| 4,978,004 | 12/1990 | Silverstein et al. | 206/224 |
| 5,000,343 | 3/1991 | Allen | 221/82 |
| 5,234,108 | 8/1993 | Jorgensen | 206/575 |
| 5,246,020 | 9/1993 | Wu | 132/295 |
| 5,477,981 | 12/1995 | Heyl et al. | 206/533 |
| 5,605,249 | 2/1997 | Gonyea | 221/6 |
| 5,632,394 | 5/1997 | Mecca et al. | 220/336 |

*Primary Examiner*—Paul T. Sewell
*Assistant Examiner*—Nhan T. Lam
*Attorney, Agent, or Firm*—Joseph N. Breaux

[57] ABSTRACT

A medication storage and serving tray device comprising a geometrically shaped chamber having a lid member and a bottom housing member wherein the lid member has integrated therewith at least one of a napkin holder and a condiment holder. The bottom housing member is preferably compartmentalized into a plurality of storage chambers for storing therein daily doses of medication. The medication storage and serving tray camouflages the medication storage and minimizes the clutter on a table top or a counter top.

1 Claim, 2 Drawing Sheets

MEDICATION STORAGE AND SERVING TRAY DEVICE

TECHNICAL FIELD

The present invention relates to medication storage devices and more particularly to a medication storage and serving tray device which integrates daily medication storage and napkin and condiment storage for minimizing the clutter on a table top or a counter top.

BACKGROUND OF THE INVENTION

Typically, medications are stored in a plurality of vials and placed on a counter top or table top for easy access thereto since some of such medications should be taken with a meal. Nevertheless, such medications generate clutter on the counter top or table top which is undecorative and bothersome. While there exist compartmentalized pill boxes for daily doses, such pill boxes are not usually stored on the table but in the patients purse, brief case or the like.

Additionally, napkin and condiment holders are known and are typically found on counter tops and table tops in order to reduce the space taken up by napkins and condiment containers, such as a salt shaker and a pepper shaker. Some such napkin and condiment holders are described and shown in U.S. Pat. No. 3,442,393, by Koppelman, and U.S. Pat. Nos. Des 171,893, Des 323,956 and Des 324,155.

It can be readily seen that there exists the continuing need for a medication storage and serving tray device which integrates daily medication storage and napkin and condiment storage for minimizing the clutter on a table top or a counter top.

SUMMARY OF THE INVENTION

The preferred embodiment of the medication storage and serving tray device of the present invention solves the aforementioned problems in a straight forward and simple manner. What is provided is a medication storage and serving tray device which integrates daily medication storage and napkin and condiment storage for minimizing the clutter on a table top or a counter top.

The medication storage and serving tray device comprising a geometrically shaped chamber having a lid member and a bottom housing member wherein the lid member has integrated therewith at least one of a napkin holder and a condiment holder.

In view of the above, an object of the invention is to provide a medication storage and serving tray device which stores a patients daily medications in a compartmentalized chamber.

Another object of the invention is to provide a medication storage and serving tray device which camouflages medication storage for safety purposes and aesthetic purposes.

It is thus a further object of the invention to provide a medication storage and serving tray device which carousels to the desired condiment for easy access thereto.

It is a still further object of the invention to provide a medication storage and serving tray which has a napkin holder wherein such napkin holder also functions as a knob means for opening a lid member of the medication storage and serving tray.

It is a still further object of the invention to provide a medication storage and serving tray device which is easy to use and simple and inexpensive to manufacture.

Other objects, advantages and salient features of the present invention will become apparent from the drawings, the description given herein, and the appended claims.

BRIEF DESCRIPTION OF DRAWING

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
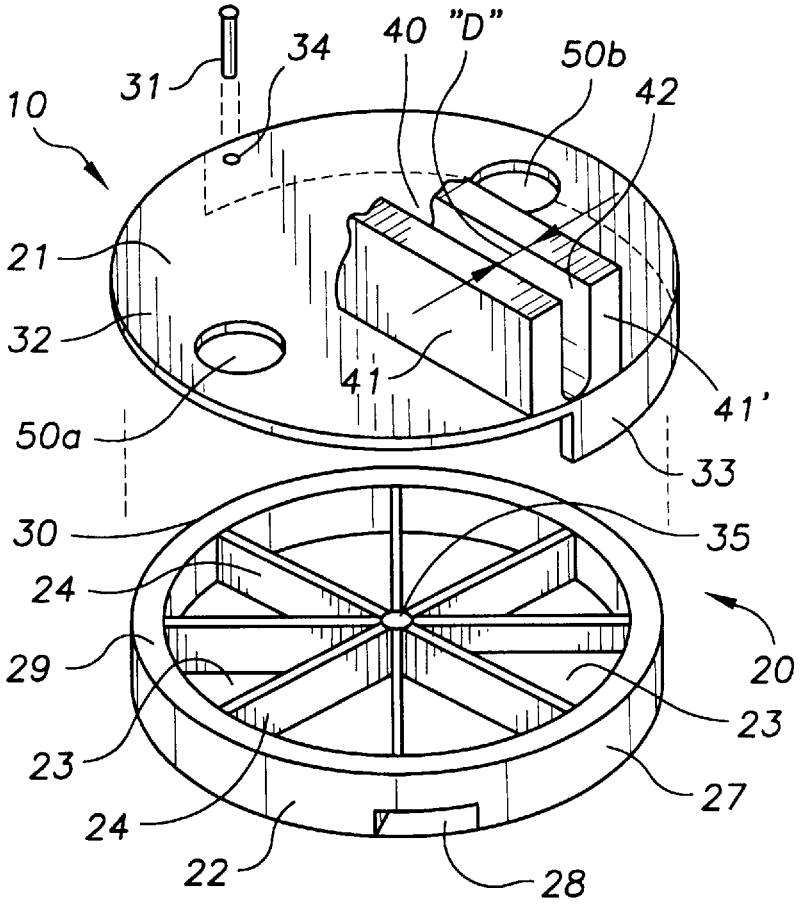
FIG. 1 illustrates an exploded view of the medication storage and serving tray device of the present invention.
Figure 2:
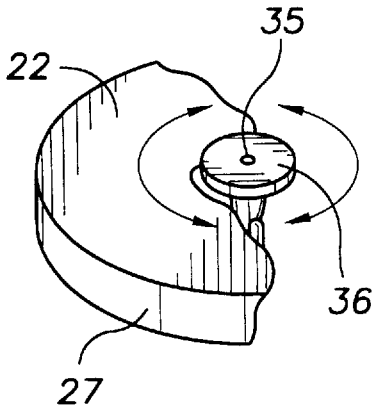
FIG. 2 illustrates a view of the carousel member of the present invention.
Figure 3:
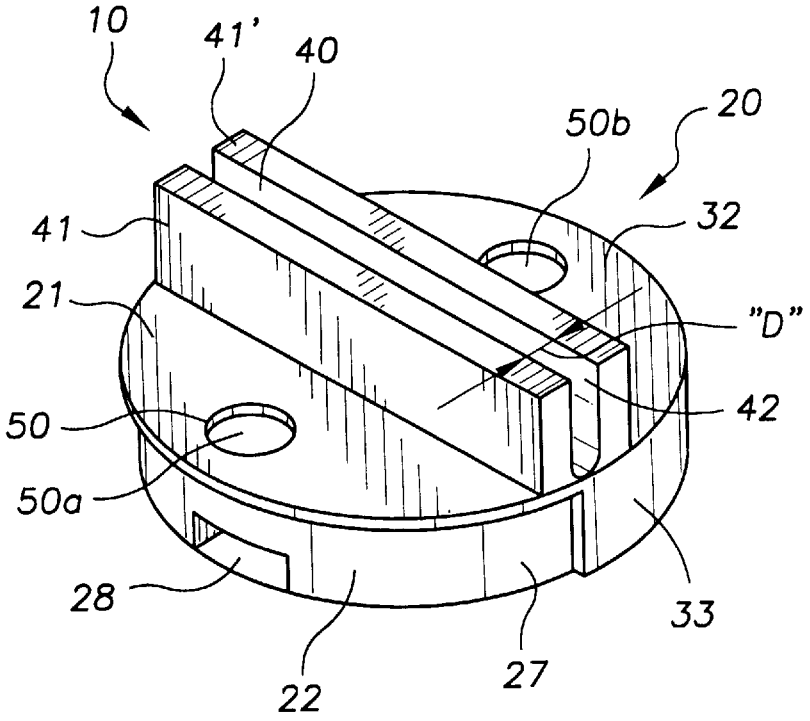
FIG. 3 illustrates a closed perspective view of the medication storage and serving tray device of the embodiment of FIG. 1.
Figure 4:
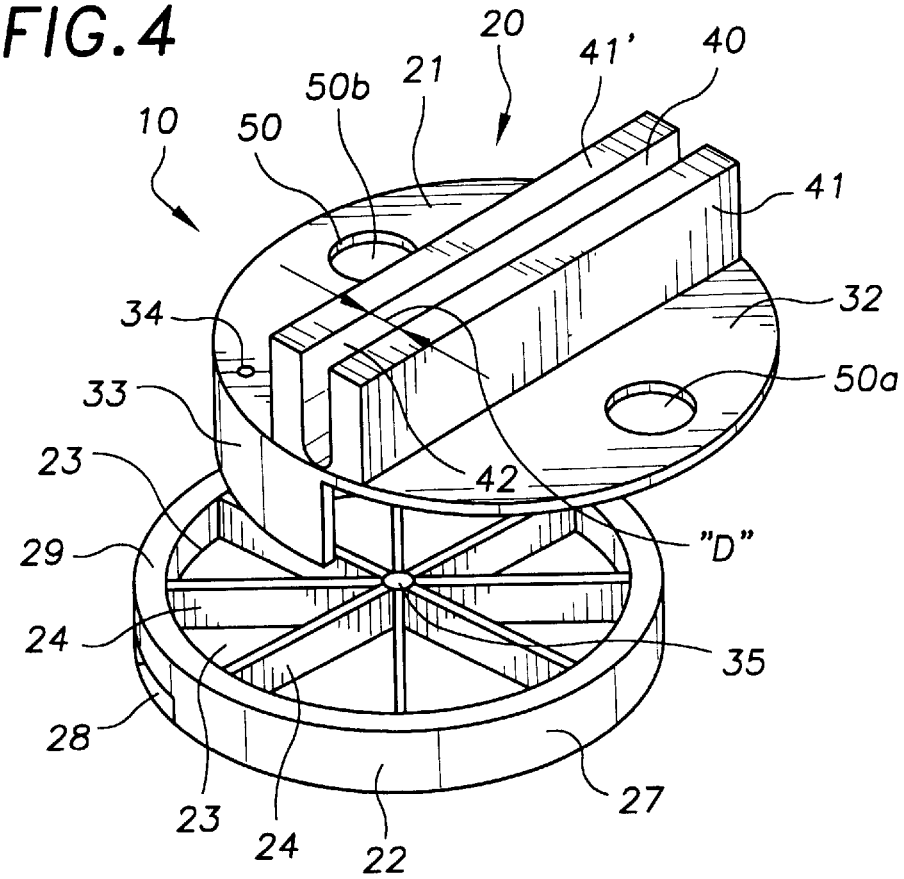
FIG. 4 illustrates an open perspective view of the medication storage and serving tray device of the embodiment of FIG. 1.

Referring now to the drawings, and in particular FIGS. 1–4, the medication storage and serving tray device of the present invention is designated generally by the numeral 10. Medication storage and serving tray device 10 is comprised of geometrically shaped chamber 20, napkin holder 40 and condiment holder 50.

Geometrically shaped chamber 20 comprises lid member 21 and bottom housing member 22. In the exemplary embodiment, geometrically shaped chamber 20 is shaped in the form of a hollow circle. Nevertheless, any shape may be substituted. Bottom housing member 22, enclosed by outer wall 27, is compartmentalized into daily storage compartments 23 via a plurality of walls 24. Since the geometrically shaped chamber 20, of the exemplary embodiment, is circular, compartments 23 are wedged shaped. The geometrically shaped chamber 20 camouflages the medications for safety purposes.

The plurality of walls 24 merge together in the center of bottom housing member 22. Such center has formed therein a channel for receiving therein pin member 35. The center of the bottom surface of bottom housing member 22 has formed therein an aperture for receiving therein carousel member 36 which is coupled to pin member 35 for revolving geometrically shaped chamber 20 about its center.

Outer wall rim 29 has formed therein an aperture 30 for receiving therein pivot pin member 31. Outer wall 27 has formed therein at least one handle recess 28 dimensioned to accommodate at least one finger whereby, bottom housing member 22 is stabilized so that lid member 21 can be rotated about pivot pin member 31 for opening geometrically shaped chamber 20. For example, bottom housing member 22 may be urged toward a table top or a counter top via the at least one handle recess 28 thereby lid member 21 is unobstructed when rotating about pivot pin member 31. Moreover, the at least one handle recess 28 or napkin holder 40 enables one to apply a force of pressure to geometrically shaped chamber 20 to spin geometrically shaped chamber 20, about carousel member 36, to the desired condiment for easy access thereto. Therefore, significant reaching, while eating, to retrieve the desired condiment is minimized.

Lid member 21 comprises top surface member 32 and embracing wall 33 unitarily coupled perpendicularly to a portion of top surface member 32 along the outer edge thereof. Embracing wall 33 is dimensioned to the contour of a portion of bottom housing member 22. Lid member 21 has formed therein aperture 34 for receiving therein pivoting rod member 31 thereby pivotally coupling lid member 21 to bottom housing member 22. In operation, to access the interior of geometrically shaped chamber 20, lid member 21 is rotated, in the direction of the arrow shown, about pivot pin member 31. In order to close geometrically shaped chamber 20, lid member 21 is rotated, in the opposite direction of the arrow shown, until embracing wall 33 abuts outer wall 27 of bottom housing member 22.

Napkin holder 40 and condiment holder 50 are integral with top surface member 32 of lid member 21. Napkin holder 40 comprises first napkin holder wall 41 and second napkin holder wall 41', parallel to first napkin holder wall 41. First napkin holder wall 41 and second napkin holder wall 41' extend the length of and are unitarily coupled to top surface member 32 of lid member 21 wherein napkin holder 40 is substantially centrally located thereon. First napkin holder wall 41 and second napkin holder wall 41' are spaced apart from each other by distance D thereby forming napkin storing chamber 42 for storing a plurality of napkins or the like therein. Moreover, if desired, envelopes may be conveniently placed in napkin storing chamber 42. Moreover, napkin holder 40 functions to provide a knob means for opening lid member 21 easily and effortlessly.

Condiment holder 50 comprises at least two indentations 50*a* and 50*b* formed in top surface member 32 of lid member 21 wherein indentation 50*a* is disposed on one side of napkin holder 40 and indentation 50*b* is disposed on the other side of napkin holder 40. The at least two indentations 50*a* and 50*b* are dimensioned to accommodate a support surface of a salt shaker (not shown) and a pepper shaker (not shown). Although the exemplary embodiment illustrates two indentations 50*a* and 50*b*, any number of indentations of varying sizes may be strategically formed in top surface member 32 of lid member 21 for storing any number of desired condiments.

In the exemplary embodiment, napkin holder 40 is substantially located in the center of lid member 21 and the at least two indentations 50*a* and 50*b* are located on the sides of napkin holder 40. Alternatively, napkin holder 40 may be located on one side of lid member 21 and the at least two indentations 50*a* and 50*b* may be located side-by-side on the other side of lid member 21. Moreover, medication storage and serving tray device 10 may omit either the napkin holder 40 or the condiment holder indentations 50*a* and 50*b*.

It can be seen from the preceding description that a medication storage and serving tray device which integrates daily medication storage and a napkin and condiment storage for minimizing the clutter on a table top or a counter top has been provided.

It is noted that the embodiment of the medication storage and serving tray device described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A medication storage and serving tray device comprising:

a chamber including a lid member and a bottom housing member enclosed by an outer wall and compartmentalized into daily storage compartments by a plurality of walls, said plurality of walls merging together at a center of said bottom housing member, said outer wall having a rim and a handle recess, said rim having an aperture formed therein into which a pivot pin member is installed, said handle recess being dimensioned to accommodate a finger of a user, said pivot pin member having said lid member pivotally mounted thereon so as to pivot tangentially over and close said daily storage compartments of said bottom housing member, said lid member including a top surface member and an embracing wall, said bracing wall being unitarily coupled perpendicularly to only a portion of said top surface member along an outer edge of said top surface member, said embracing wall being shaped to conform to a portion of said bottom housing member;

a napkin holder centrally positioned on said top surface member of said lid member and including a first napkin holder wall and a second napkin holder wall, said second napkin holder wall being spaced from and oriented parallel to said first napkin holder wall, said first napkin holder wall and said second napkin holder wall each extending the length of said lid member, said first napkin holder wall and said second napkin holder wall each being unitarily coupled to said top surface member of said lid member; and a condiment holder including an indentation formed into said top surface member of said lid member.

* * * * *